US008938825B1

(12) United States Patent
Ritchey

(10) Patent No.: US 8,938,825 B1
(45) Date of Patent: Jan. 27, 2015

(54) REVERSIBLE FITTED SHEET

(71) Applicant: Gail Ritchey, Birmingham, AL (US)

(72) Inventor: Gail Ritchey, Birmingham, AL (US)

( * ) Notice: Subject to any disclaimer, the term of this patent is extended or adjusted under 35 U.S.C. 154(b) by 0 days.

(21) Appl. No.: 14/227,301

(22) Filed: Mar. 27, 2014

(51) Int. Cl.
*A47G 9/02* (2006.01)
*A47C 27/00* (2006.01)

(52) U.S. Cl.
CPC ..... *A47G 9/0246* (2013.01); *A47C 27/002* (2013.01)
USPC ..... 5/499; 5/738

(58) Field of Classification Search
CPC ..... A47C 27/002
USPC ..... 5/482, 486, 499, 500, 738, 907
See application file for complete search history.

(56) References Cited

U.S. PATENT DOCUMENTS

| | | | | | |
|---|---|---|---|---|---|
| RE24,591 | E * | 1/1959 | Schwartz | ..... | 5/499 |
| 5,323,501 | A * | 6/1994 | Kuhangel | ..... | 5/499 |
| 5,642,540 | A * | 7/1997 | Culver et al. | ..... | 5/499 |
| 6,065,164 | A * | 5/2000 | Swanger et al. | ..... | 5/420 |
| 6,067,677 | A * | 5/2000 | Reen et al. | ..... | 5/499 |
| 6,381,778 | B1 * | 5/2002 | Peterson | ..... | 5/497 |
| 6,634,042 | B2 * | 10/2003 | Blossman | ..... | 5/499 |
| 6,804,844 | B2 * | 10/2004 | Cushing | ..... | 5/497 |
| 7,003,832 | B2 * | 2/2006 | Wilson | ..... | 5/655 |
| 2010/0088819 | A1 * | 4/2010 | Carter et al. | ..... | 5/484 |

FOREIGN PATENT DOCUMENTS

| | | | | |
|---|---|---|---|---|
| GB | 2402058 A * | 12/2004 | ..... | A47C 31/00 |

* cited by examiner

*Primary Examiner* — Michael Trettel
(74) *Attorney, Agent, or Firm* — Braxton, Hilton & Perrone, PLLC

(57) ABSTRACT

A system and method for a reversible sheet. The fitted sheet has a top layer with an inner side and an outer side and a bottom layer with an inner side and an outer side. The top layer is coupled to the bottom layer by a sealed top edge, a sealed base edge, and a sealed bottom edge. The sealed base edge is perpendicular to the top edge and the bottom edge. The top layer and bottom layer each have a flap portion which has an open flap and an open end edge. A mattress is inserted into the open end edge. The front end of the mattress is secured into the open flap of either the top or bottom layer. This secures the fitted sheet around the mattress. A child cannot pull the fitted sheet away from the mattress because the fitted sheet surrounds the mattress.

17 Claims, 3 Drawing Sheets

REVERSIBLE FITTED SHEET

BACKGROUND OF THE INVENTION

1. Technical Field

The present invention relates to a system and method of making a reversible fitted sheet.

2. Description of Related Art

Fitted sheets typically comprise a top layer and an anchoring device, such as elastic, which affix to the below mattress. However, such a fitted sheet is easily removed from the mattress. Consequently, there is a need for a fitted sheet which more securely anchors to the mattress.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
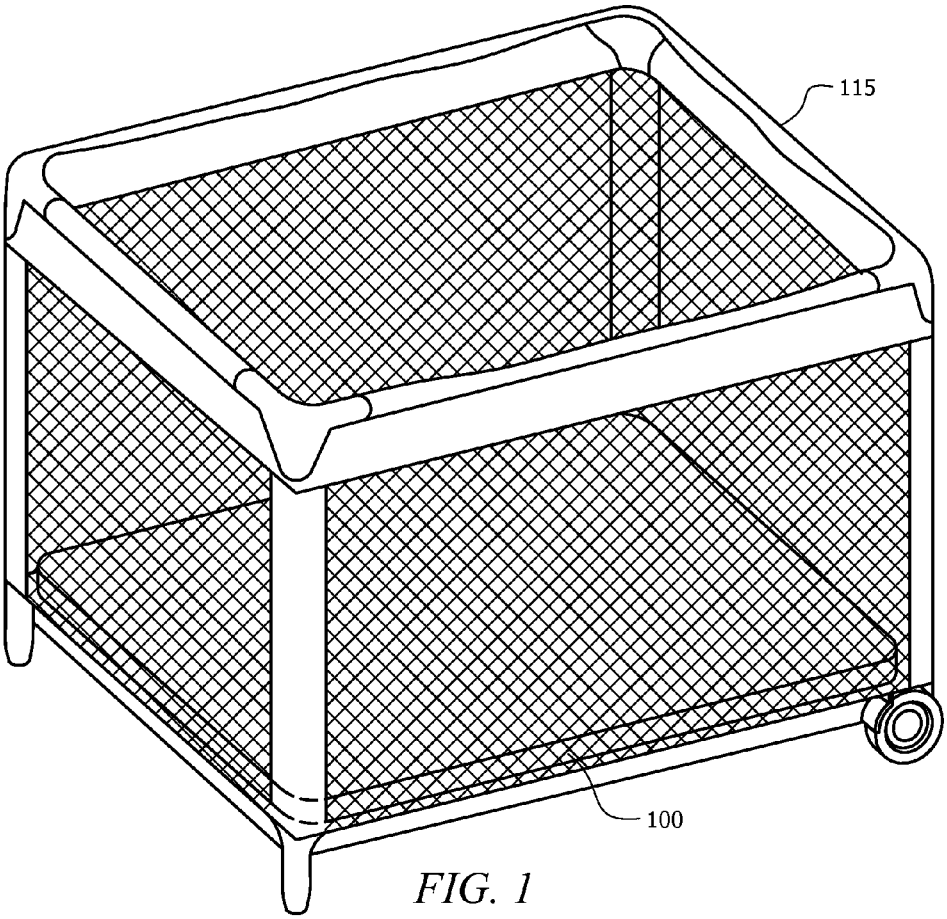
FIG. 1 is a perspective view of a mattress in a play pen in one embodiment.

FIG. 1 is a perspective view of a play pen in one embodiment. As can be seen, the mattress 100 is located at the bottom of the play pen. The mattress 100 can comprise virtually any type of mattress of virtually any shape. The play pen 115, as used herein, refers to any enclosure which is used to house a baby. A play pen 115 includes a crib, a bed, a play yard, a bassinet, travel crib, and other such structures. One example of a play yard is a Pack 'N Play manufactured by Graco of Freeport Ill.

A play pen 115 serves as a safe place where children can play, sleep, and relax. Often, the play pen 115 comprises a mattress 100 at the bottom. As depicted, the play pen 115 has vertical support members coupled to netting or other device which prevents the child from falling from the play pen 115.

In one embodiment a sheet is used to cover the mattress 100. A sheet offers protection to the mattress 100, and serves as a removable and washable layer. In the event of a spill, the sheet can simply be removed, washed, and replaced.

In one embodiment, a fitted sheet is used to cover the mattress 100. As used herein, a fitted sheet refers to a sheet which fits around a mattress so as to not be easily removed.

Figure 2:
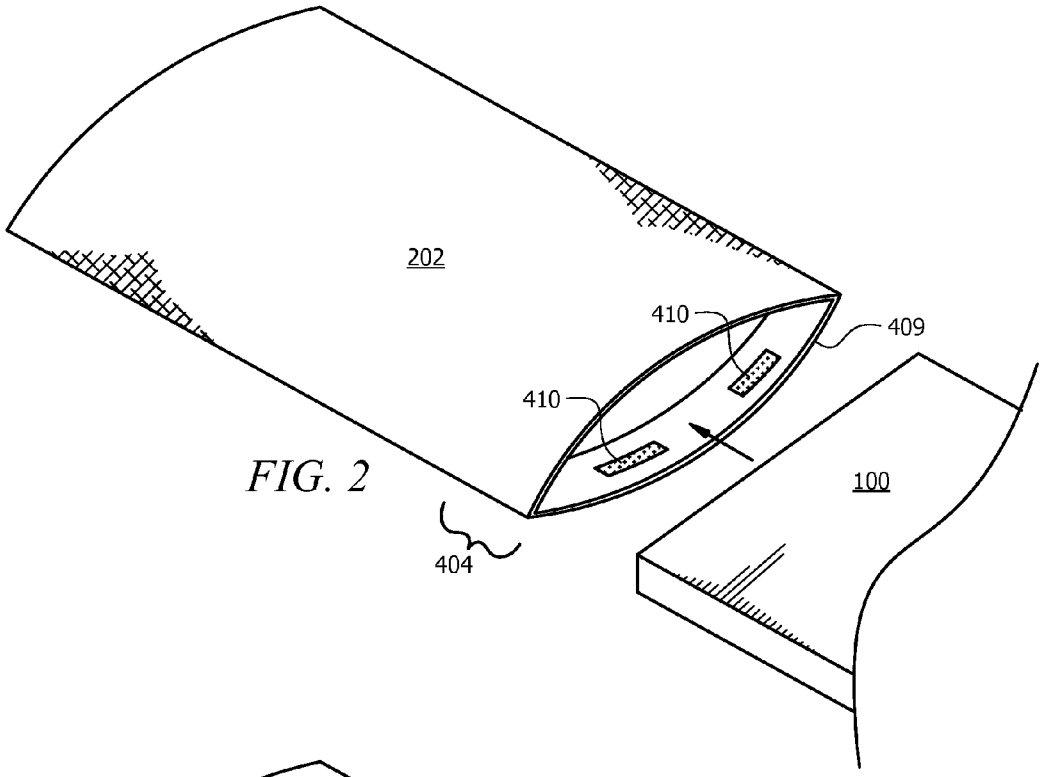
FIG. 2 is a top perspective view of a top layer of a fitted sheet in one embodiment.
Figure 3:
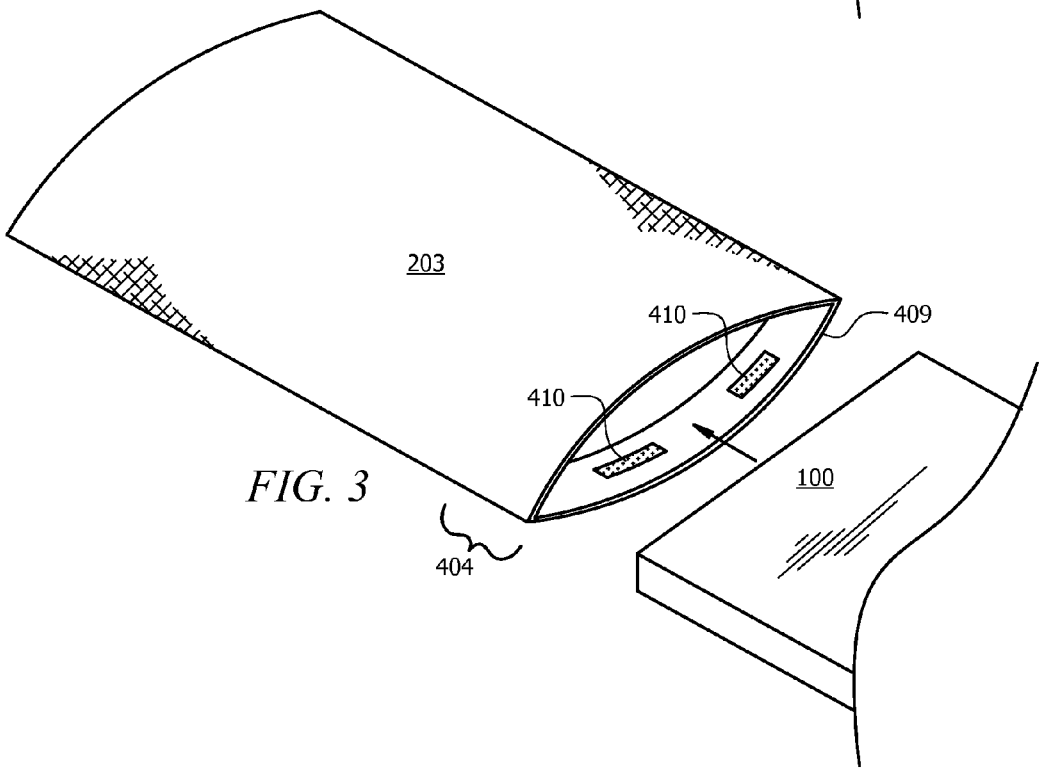
FIG. 3 is a top perspective view of a bottom layer of a fitted sheet in one embodiment.

FIG. 2 is a top perspective view of a top layer 202 of a fitted sheet in one embodiment. FIG. 3 is a top perspective view of a bottom layer 203 of a fitted sheet in one embodiment. FIGS. 2 and 3 show that the mattress 100 is inserted into the opening of the fitted sheet 201. The fitted sheet 201 depicted in FIGS. 2 and 3 is rectangular, but this shape should not be deemed limiting. The fitted sheet 201 can comprise virtually any shape, including square, polygons, circular, etc. In one embodiment the fitted sheet 201 mimics the shape of the mattress. Thus, for example, if the mattress is square then the fitted sheet 201 will be square.

In one embodiment, the top layer 202 and the bottom layer 203 each comprise a dissimilar pattern. Thus, when fitted around a mattress 100, the fitted sheet 201 can be rotated 180° and a different pattern can be displayed. This is an advantage because it provides the user an opportunity to display multiple patterns, colors, etc. with a single sheet. For example, the top layer 202 can comprise a solid purple color. When the top layer 202 is oriented to be atop the mattress, the top layer 202 is referred to as the exposed layer. Thus, the child would lay and play on the solid purple color. If the bottom layer comprises black and white stripes, then when rotated, the bottom layer 203 becomes the exposed layer, and the child would lay and play on the black and white stripes. The user can rotate the fitted sheet 201 to match the surroundings, match the child's outfits, match bedding, etc. Thus, in one embodiment, the fitted sheet 201 comprises dissimilar top 202 and bottom layers 203. As noted, the top 202 and bottom layers 203 can vary in patterns, color, etc.

Additionally, in one embodiment the top 202 and bottom layers 203 can differ in material. As an example, in one embodiment the top layer 202 comprises a flannel material whereas the bottom layer 203 comprises a cotton sheeted material. This provides the user the opportunity to select from multiple materials using a single fitted sheet 201. The fitted sheet 201 can comprise virtually any type of material, including but not limited to, flannel, cotton, polyester, poly blend, quilted, fleece, muslin, and virtually any material from which sheets are currently manufactured. In one embodiment the material comprises a water-proof or water resistant fabric which would can be used as a spill proof fabric.

In other embodiments, however, the fitted sheet 201 comprises similar top 202 and bottom layers 203. For example, in one embodiment the top 202 and bottom layers 203 comprise the same pattern and color.

As depicted in FIGS. 2 and 3, the top 202 and bottom layers 203 are directly coupled to one another. Thus, there are no side panels connected to the top 202 and bottom layers 203. In one embodiment, without any upward force, the fitted sheet 201 is flat. However, as depicted in FIG. 2, if an upward force is applied to the top layer 202, then the opening of the fitted sheet 201 comprises a football-shape as depicted in FIG. 2. If the fitted sheet of FIG. 2 is flipped over such that the bottom layer 203 is now visible, and an upward force is applied to the bottom layer 203, the shape depicted in FIG. 3 would result.

While the figures depicted in FIGS. 2 and 3 do not have side panels, and consequently, the top 202 and bottom layers 203 are directly coupled to one another, in other embodiments, the top 202 and bottom layers 203 are coupled via side panels, as discussed in more detail below.

Figure 4:
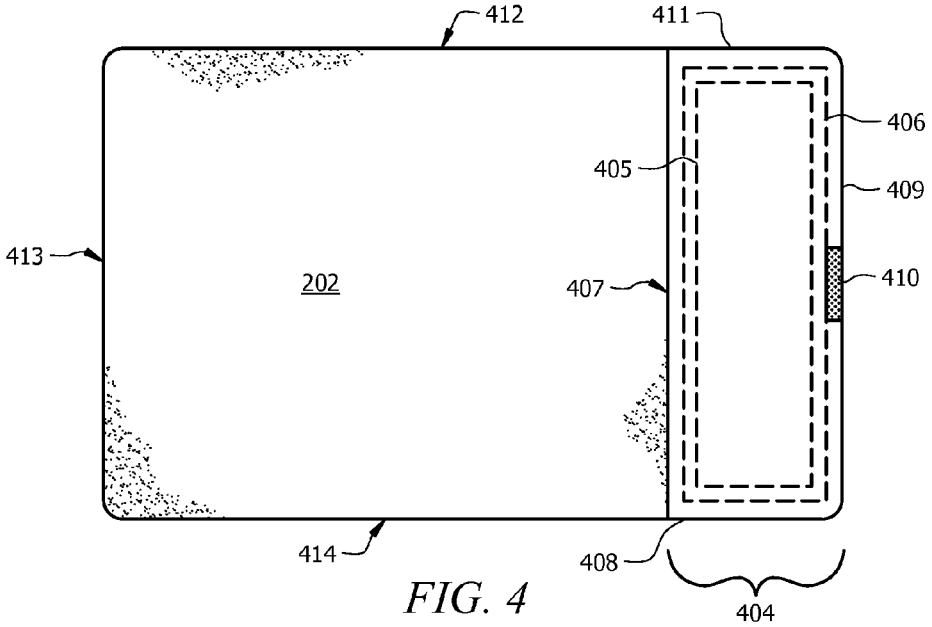
FIG. 4 is an inside top view of a top layer of a fitted sheet in one embodiment.

FIG. 4 is an inside top view of a top layer of a fitted sheet in one embodiment. As depicted the top layer 202 has a top edge 412, a bottom edge 414, a base edge 413, and a flap portion 404. The fitted sheet can have virtually any dimensions, depending upon the dimension of the mattress. In one embodiment the sheet is between about 30 and 50 inches in length and about 20 to about 40 inches in width for a regular play yard. The top edge 412 is the edge of the top layer 202 which is located at the top. In one embodiment, the top edge 412 of the top layer 202 is coupled to the top edge 412 of the bottom layer 203. As used herein, coupled refers to an item which is directly or indirectly adhered. As an example, in one embodiment, the top edges 412 of the top 202 and bottom layers 203 are coupled via thread such as by stitching or sewing. In other embodiments, the top edges 412 and the top 202 and bottom layers 203 are coupled because they are integrally made, such as being made from the same piece of fabric. For example, one piece of fabric can be folded so as to form a top 202 and bottom layer 203. In such scenarios, the top edges 412 of the top 202 and bottom layers 203 are coupled. Virtually any device or method known in the art to couple fabrics can be utilized. These include thread, sewing, stitching, gluing, taping, etc.

In one embodiment, the top edge 412 is a sealed edge. As used herein, a sealed edge refers to a side or edge which is typically sealed such that it cannot be opened during normal operation. As an example, when the top edges 412 are sewn together, the resulting edge is a sealed edge because it cannot be opened during normal operation. Thus, the mattress cannot be retrieved through a sealed edge during normal operation. Conversely, an open edge refers to an edge which is open and not sealed.

Turning back to FIG. 4, the top layer 202 comprises a base edge 413. In one embodiment the base edge 413 of the top layer 202 is coupled to the base edge 413 of the bottom layer 203. In one embodiment the base edge 413 is a sealed edge.

As depicted, the top layer 202 also comprises a bottom edge 414. In one embodiment the bottom edge 414 of the top layer 202 is coupled to the bottom edge 414 of the bottom layer 203. In one embodiment the bottom edge 414 is a sealed edge.

The top layer 202, as depicted, comprises a flap portion 404. The flap portion 404, in one embodiment, comprises an open flap 407. In one embodiment the open flap 407 is not sealed. The flap 407 can comprise virtually any length. In one embodiment the flap 407 is longer than the thickness of the mattress. In one embodiment the flap 407 is greater than 2 inches in length. In one embodiment the mattress has a thickness of about 0.5 inches to about 6, while in other embodiments the mattress is greater than about 6 inches. In still other embodiments the mattress has a thickness of between about 0.5 inches to about 4 inches, while in another embodiment the mattress has a thickness of about 0.5 inches to about 1 inch.

The flap portion 404, as depicted, also comprises a top flap edge 411 and a bottom flap edge 408. In one embodiment the top flap edge 411 of the top layer 202 is coupled to the top flap edge 411 of the bottom layer 203, and the bottom flap edge 408 of the top layer 202 is coupled to the bottom flap edge 408 of the bottom layer 203. Thus, in one embodiment, the top flap edges 411 and the bottom flap edges 408 are sealed edges.

The flap portion 404 also comprises an open end edge 409. The open end edge 409 is an open edge through which the mattress is inserted and removed. As can be seen, if the top edge 412, the base edge 413, the bottom edge 414, the top flap edge 411, and the bottom flap edge 408 are all sealed edges, there is only a single open end located at the open end edge 409 through which a mattress can be inserted and retrieved. In one embodiment wherein the top layer 202 and the bottom layer 203 are coupled, the only unsealed opening is the open end edges 409 of both layers as well as the open flap 407. This forms an opening through which the mattress can be inserted and retrieved.

As depicted, the flap portion 404 also comprises a support layer 406 secured by stitching or other coupling device 405. As depicted, the support layer 406 is located on the inner layer of the open flap 407. The support layer 406 can comprise virtually any material, and comprises an additional layer which offers support and rigidity to the open flap 407. In one embodiment the support layer 406 comprises interfacing. In one embodiment the support layer 406 helps keep the flap 407 from being pulled out easily by a child. In one embodiment comprising two flaps 407, both flaps comprise a support layer 406.

In one embodiment the flap portion 404 is formed by taking a length of fabric and folding a portion over to form the overlap portion 404. Thus, the open end edge 409, in one embodiment, is formed by a fold or crease. The open flap 407 is thus open and not sealed so that it can receive a mattress end, as will be discussed below.

As discussed, in one embodiment the fitted sheet comprises at least three sealed edges and at least one opening located at the open end edge 409. The fitted sheet 201 comprises a top layer 202 and a bottom layer 203 coupled to allow only a single opening located at open end edge 409. The use of the fitted sheet 201, in one embodiment, will now be discussed.

A mattress is inserted into the fitted sheet 201 through the opening located at the open end edge 409. This can be seen in FIGS. 2 and 3. The mattress is pushed all the way into the sheet so that it's back end adjacent to the base edge 413. Now, the mattress is secured by three sealed edges. The front end of the mattress is now adjacent to the flaps 407 of the fitted sheet.

Next, the open end edge 409 is secured. The front end of the mattress is inserted into the open flap 407 of one of the layers. Either the top 202 or the bottom 203 can be utilized. An embodiment will be discussed wherein the flap 407 of the top layer 202 is utilized, but this is for illustrative purposes only and should not be deemed limiting. Utilizing the flap 207 of the top 202 layer to secure the mattress allows the weight of the mattress and the child to rest upon the flap 207. The child will have to overcome this weight to dislodge the mattress from the flap 207.

Once the front end of the mattress is inserted into the flap 407 of the top layer 202, the mattress is secure within the fitted sheet 101. In one embodiment the mattress will need to be smashed or folded, depending upon the length of the mattress and the fitted sheet 101, to fit within the flap 407. Because, in one embodiment, the mattress is between about 0.5 and 1 inch thick, the mattress can be manipulated to fit within the flap 407. The overlap 404 of the top layer 202 can then fold atop the overlap 404 of the bottom layer 203.

In one embodiment, the overlap 404 comprises an attaching device 410. In one embodiment the attaching device 410 is located on the inner side of both the top 202 and bottom 203 layers. As such, when the fitted sheet 201 is secured to the mattress, the attaching device 410 is not visible. This is an advantage in than it is not only more visibly appealing, but it prevents the child from laying on or otherwise accessing the attaching device 410. The attaching device 410 can comprise any device which releasably attaches two items. The attaching device 410 can include, for example, Velcro®, snaps, etc. In one embodiment the Velcro® Hook and Loop tape manufactured by Velcro® of Manchester, N.H. is utilized. While one attaching device 410 has been illustrated in FIG. 4, this is for illustrative purposes only and should not be deemed limiting. For example, in one embodiment, the top 202 and bottom 203 layers each comprise two or more attaching devices 410 as depicted in FIGS. 2 and 3.

Once the mattress has been inserted into the flap 407 of the top layer 202, the attaching device 410 releasably secures the top layer 202 to the bottom layer 203, securing the mattress within the fitted sheet 201 and the fitted sheet 201 around the mattress. In one embodiment comprising Velcro, the attaching device 410 from the top layer 202 and the bottom layer 203 meet and releasably attach. As noted, this secures the fitted sheet 201 around the mattress, and prevents the sheet from becoming easily removed.

To remove the mattress from the fitted sheet 201, the steps are reversed. Namely, the top 202 and bottom layers 203 are decoupled by releasing the attaching device 410. Thereafter, the mattress is retrieved through the opening.

Figure 5:
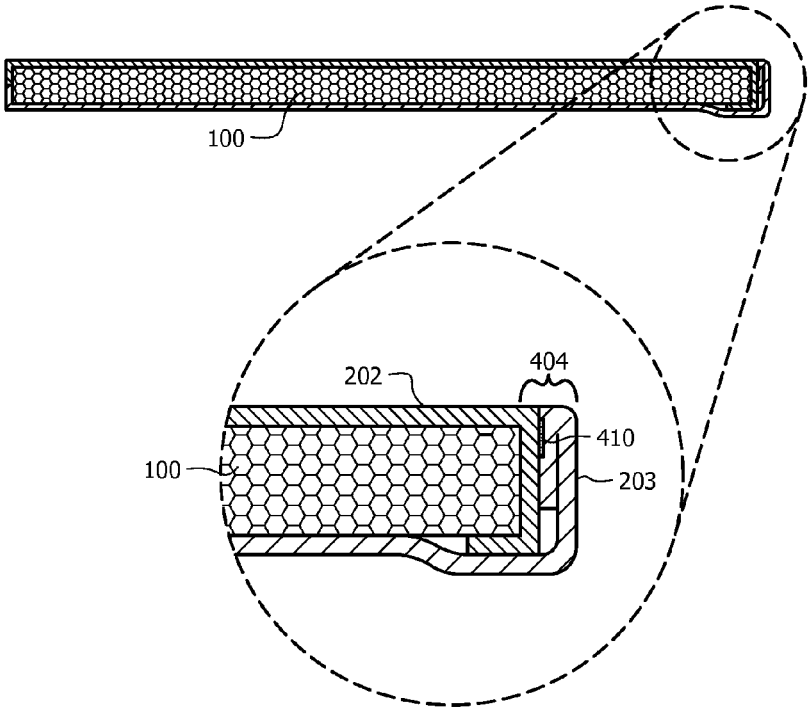
FIG. 5 is a side cross-sectional view of a fitted sheet located on a mattress in one embodiment.

FIG. 5 is a side-cross sectional view of the fitted sheet in one embodiment. As depicted the mattress 100 is inserted into the flap of the top layer 202. The bottom layer 203 couples with the top layer 202 via the attaching device 410.

While an embodiment has been described wherein the overlap portion 407 has a sealed top 411 and bottom edge 408, in other embodiments the top 411 and bottom edge 408 is not sealed. Such an embodiment can have many uses, including, as one non-limiting example, an embodiment utilizing a crib mattress with a thickness of about 4 inches or greater. In one such embodiment, the top 202 and bottom layer 203 are coupled via side panels which are oriented in a plane perpendicular to the top 202 and bottom 203 layers. Thus, in one such embodiment, the fitted sheet 201 comprises the shape of a three-dimensional rectangle wherein the top 202 and bottom layers 203 comprise the front and back faces, and the side panels comprise the top and bottom faces. As noted, the top 411 and bottom edges 408 of the overlap portion 407 are not sealed. Thus, the flap 407 is allowed to freely move. In one embodiment utilizing a crib mattress, the flap 407 is extended so that the flap 407 extends downward to cover the end of the mattress when coupled with a second flap 407.

The fitted sheet disclosed herein has several benefits. The first is increased safety. Sudden Infant Death Syndrome (SIDS) is the leading cause of death for infants between 1 month and one year. Blankets, comforters, etc., can cause rebreathing, during which the infants inhale and exhale the same air which is trapped by the blankets, etc. Rebreathing can cause SIDS. The fitted sheet 201 discussed herein offers increased securement compared to prior art sheets which can more easily be removed. Because the fitted sheet 201 encompasses the entire mattress, and because the bottom layer 203 is secured and pinned down by both the weight of the mattress and the weight of the child, it is very unlikely that the fitted sheet 201 can be removed during use. Instead, as noted, the mattress typically has to be removed from the play pen before the fitted sheet 201 can be removed. In prior art sheets, if the child rolls or rotates, such force on the sheet can be enough for the sheet to be dislodged from the mattress resulting in a potential hazard for SIDS. Because the fitted sheet 201 offers increased securement, the chances of the fitted sheet 201 becoming dislodged from the mattress during use is significantly reduced if not eliminated, resulting in a safer fitted sheet.

Aside from safety, the fitted sheet 201 offers increased performance. A fitted sheet should remain lodged and coupled to the mattress. The prior art sheets fail in this regard. Accordingly, the user must continually reattach the fitted sheets, which typically comprise an elastic material which couples only to the corner of the mattress. Such attachment is ineffective and results in the sheet detaching from the mattress if the child or infant moves or rolls within the play pen. The user must then reach down into the play pen and reattach the sheet. Often, during play time, this must be accomplished several times per day. If the user, such as the mother, for example, is short, then reaching down into the play pen to re-attach the sheets is problematic. The fitted sheet 201 discussed herein, however, remains coupled to the mattress until the mattress is removed. As can be seen in the play pen 115 of FIG. 1, if the fitted sheet 201 were attached to the mattress 100, there is insufficient room within the play pen 115 to remove the fitted sheet 201 with the mattress 100 located in the play pen 115. Thus, in the embodiment depicted, the mattress 100 would need to be removed from the play pen 115 to remove the fitted sheet 201. This illustrates how secure the fitted sheet 201 is to the mattress 100. As such, the fitted sheet 201, unlike the prior art, remains lodged and coupled to the mattress.

Next, the fitted sheet 201 discussed herein offers versatility. In one embodiment, as discussed above, the fitted sheet 201 is reversible. Consequently, if the exposed layer becomes slightly messy, such as by a light spill, the mattress can be flipped over and a new and fresh layer is exposed. This extends the life of the fitted sheet 201 between washes. Further, as described above, in one embodiment the top 202 and bottom 203 layers comprise dissimilar patterns. Thus, the fitted sheet 201 can be flipped depending upon outfits, blankets, etc.

While the invention has been particularly shown and described with reference to a preferred embodiment, it will be understood by those skilled in the art that various changes in form and detail may be made therein without departing from the spirit and scope of the invention.

ADDITIONAL DESCRIPTION

The following clauses are offered as further description of the disclosed invention.

Clause 1. A fitted sheet comprising:

a top layer comprising an inner side and an outer side;

a bottom layer comprising an inner side and an outer side;

wherein the top layer and the bottom layer each comprise a flap portion, wherein each flap portion comprises an open flap and an open end edge, wherein the open flap and open end edge are approximately parallel to the sealed base edge.

Clause 2. The fitted sheet of any proceeding or preceding clause wherein the top layer is coupled to the bottom layer by a sealed top edge, a sealed base edge, and a sealed bottom edge, wherein the sealed base edge is oriented perpendicular to the top edge and the bottom edge; and wherein said flap portion further comprises a sealed top flap edge and a sealed bottom flap edge.

Clause 3. The fitted sheet of any proceeding or preceding clause wherein both the top flap edge and bottom flap edge are oriented approximately perpendicular to the open flap.

Clause 4. The fitted sheet of any proceeding or preceding clause wherein the flap portion further comprises an attaching device, wherein said attaching device is located on one of said inner layers.

Clause 5. The fitted sheet of any proceeding or preceding clause wherein the outer layer of the top layer and the outer layer of the bottom layer comprise dissimilar patterns.

Clause 6. The fitted sheet of any proceeding or preceding clause further comprising a mattress located within said fitted sheet.

Clause 7. The fitted sheet of any proceeding or preceding clause wherein said mattress comprises a front end and a back end, wherein said back end of the mattress is adjacent to the sealed back edge; wherein the front end is secured within the open flap of said bottom layer.

Clause 8. The fitted sheet of any proceeding or preceding clause wherein the flap portion of said top and bottom layer further comprises an attaching device, and wherein said attaching devices couple to secure said mattress.

Clause 9. The fitted sheet of any proceeding or preceding clause wherein said attaching device is located on an inner layer of said top layer and an inner layer of said bottom layer.

Clause 10. The fitted sheet of any proceeding or preceding clause comprising two or more attaching devices.

Clause 11. The fitted sheet of any proceeding or preceding clause wherein said mattress is located in a play pen.

Clause 12. The fitted sheet of any proceeding or preceding clause wherein said mattress comprises a thickness between about ½ inch and about 6 inches.

Clause 13. The fitted sheet of any proceeding or preceding clause wherein said flap portion further comprises a support layer.

Clause 14. The fitted sheet of any proceeding or preceding clause wherein said flap portion comprises a length of fabric which is folded over to form an overlap.

Clause 15. The fitted sheet of any proceeding or preceding clause wherein said open end edge is formed by a fold.

Clause 16. A method of covering a mattress with a fitted sheet, said method comprising the steps of:

a) obtaining a fitted sheet, wherein said fitted sheet comprises:

a top layer comprising an inner side and an outer side;

a bottom layer comprising an inner side and an outerside;

wherein the top layer is coupled to the bottom layer by a sealed top edge, a sealed base edge, and a sealed bottom edge, wherein the sealed base edge is oriented perpendicular to the top edge and the bottom edge;

wherein the top layer and the bottom layer each comprise a flap portion, wherein each flap portion comprises an open flap and an open end edge, wherein the open flap and open end edge are approximately parallel to the sealed base edge;

b) inserting a mattress, which comprises a front end and a back end, through said open end edge such that the back end of said mattress is adjacent to said sealed base edge;

c) positioning the front end of said mattress into an open flap of one of said layers.

Clause 17. The method of any proceeding or preceding clause further comprising step d) securing the top layer to the bottom layer via an attaching device.

Clause 18. The method of any proceeding or preceding clause wherein step c) comprises position the front end of said mattress into an open flap of the top layer.

I claim:

1. A fitted sheet comprising:

a top layer comprising an inner side and an outer side;

a bottom layer comprising an inner side and an outer side;

wherein the top layer is coupled to the bottom layer by a sealed top edge, a sealed base edge, and a sealed bottom edge, wherein the sealed base edge is oriented perpendicular to the top edge and the bottom edge;

wherein the top layer and the bottom layer each comprise a flap portion, wherein each flap portion comprises an open flap and an open end edge, wherein the open flap and open end edge are approximately parallel to the sealed base edge; and wherein said flap portion further comprises a sealed top flap edge and a sealed bottom flap edge.

2. The fitted sheet of claim 1 wherein both the top flap edge and bottom flap edge are oriented approximately perpendicular to the open flap.

3. The fitted sheet of claim 1 wherein the flap portion further comprises an attaching device, wherein said attaching device is located on one of said inner sides.

4. The fitted sheet of claim 1 wherein the outer side of the top layer and the outer side of the bottom layer comprise dissimilar patterns.

5. The fitted sheet of claim 1 further comprising a mattress located within said fitted sheet.

6. The fitted sheet of claim 5 wherein said mattress comprises a front end and a back end, wherein said back end of the mattress is adjacent to the sealed back edge; wherein the front end is secured within the open flap of said bottom layer.

7. The fitted sheet of claim 6 wherein the flap portion of said top and bottom layer further comprises an attaching device, and wherein said attaching devices couple to secure said mattress.

8. The fitted sheet of claim 7 wherein said attaching device is located on an inner layer of said top layer and an inner layer of said bottom layer.

9. The fitted sheet of claim 8 comprising two or more attaching devices.

10. The fitted sheet of claim 7 wherein said mattress is located in a play pen.

11. The fitted sheet of claim 7 wherein said mattress comprises a thickness between about ½ inch and about 6 inches.

12. The fitted sheet of claim 1 wherein said flap portion further comprises a support layer.

13. The fitted sheet of claim 1 wherein said flap portion comprises a length of fabric which is folded over to form an overlap.

14. The fitted sheet of claim 9 wherein said open end edge is formed by a fold.

15. A method of covering a mattress with a fitted sheet, said method comprising the steps of:

a) obtaining a fitted sheet, wherein said fitted sheet comprises:

a top layer comprising an inner side and an outer side;

a bottom layer comprising an inner side and an outerside;

wherein the top layer is coupled to the bottom layer by a sealed top edge, a sealed base edge, and a sealed bottom edge, wherein the sealed base edge is oriented perpendicular to the top edge and the bottom edge;

wherein the top layer and the bottom layer each comprise a flap portion, wherein each flap portion comprises an open flap and an open end edge, wherein the open flap and open end edge are approximately parallel to the sealed base edge;

b) inserting a mattress, which comprises a front end and a back end, through said open end edge such that the back end of said mattress is adjacent to said sealed base edge;

c) positioning the front end of said mattress into an open flap of one of said layers.

16. The method of claim 15 further comprising step d) securing the top layer to the bottom layer via an attaching device.

17. The method of claim 16 wherein step c) comprises position the front end of said mattress into an open flap of the top layer.

* * * * *